United States Patent [19]

Bailey et al.

[11] Patent Number: 4,732,435

[45] Date of Patent: Mar. 22, 1988

[54] REFRIGERATOR CRISPER DRAWER STRUCTURE

[75] Inventors: Curtis J. Bailey; Richard A. Heck, both of Birmingham; Richard Waisanen, Warren, all of Mich.

[73] Assignee: Whirlpool Corporation, Benton Harbor, Mich.

[21] Appl. No.: 928,167

[22] Filed: Nov. 7, 1986

[51] Int. Cl.[4] ..... A47B 88/04

[52] U.S. Cl. ..... 312/311; 312/274; 312/330 R

[58] Field of Search ..... 312/311, 138 R, 236, 312/138 A, 330, 274

[56] References Cited

U.S. PATENT DOCUMENTS

| | | | |
|---|---|---|---|
| 2,665,817 | 1/1954 | Whitmore | 220/20 |
| 2,808,310 | 10/1957 | Patterson, Jr. | 312/325 |
| 3,172,714 | 3/1965 | Kesling | 312/236 |
| 3,259,269 | 7/1966 | Asenbauer | 220/97 |
| 3,339,994 | 9/1967 | Reddig et al. | 312/301 |
| 4,015,713 | 4/1977 | Clipson et al. | 206/509 |
| 4,186,978 | 2/1980 | Thomson | 312/138 A |
| 4,539,819 | 9/1985 | Alba et al. | 62/78 |

FOREIGN PATENT DOCUMENTS

| | | | |
|---|---|---|---|
| 28923 | 8/1903 | Switzerland | 312/311 |

OTHER PUBLICATIONS

Sanyo sale literature-9 pages, no date.

*Primary Examiner*—Joseph Falk

*Attorney, Agent, or Firm*—Wood, Dalton, Phillips, Mason & Rowe

[57] ABSTRACT

A crisper drawer structure for use in a refrigerator wherein a front portion of the crisper drawer extends into subjacent relationship to a rearwardly projecting shelf on the refrigerator door in the closed arrangement of the refrigerator. A transparent cover member is pivotally mounted to the drawer guides to close the front portion of the crisper drawer in the storage disposition while allowing ready viewability of the contents thereof by the user. The cover member automatically moves between the closing disposition when the crisper drawer is in the storage arrangement to an uncovered disposition when the crisper drawer is brought forwardly to the access arrangement. The arrangement of the cover member is such as to effectively preclude retention of articles thereon, thereby avoiding impact damage to the door shelf by abutment with such articles upon closing of the door.

15 Claims, 5 Drawing Figures

FIG. 1
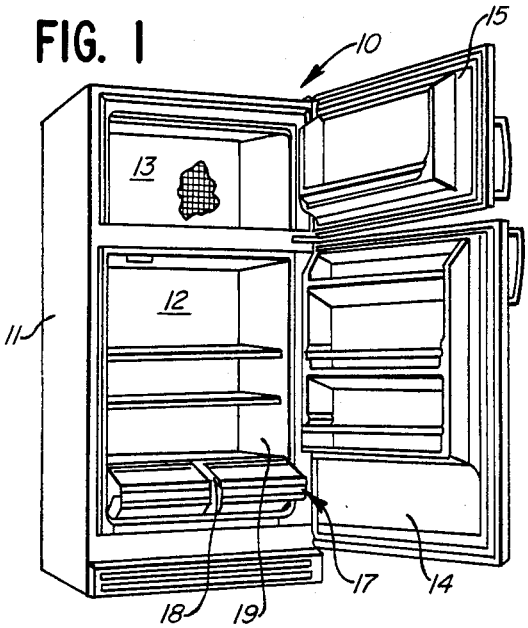
FIG. 2
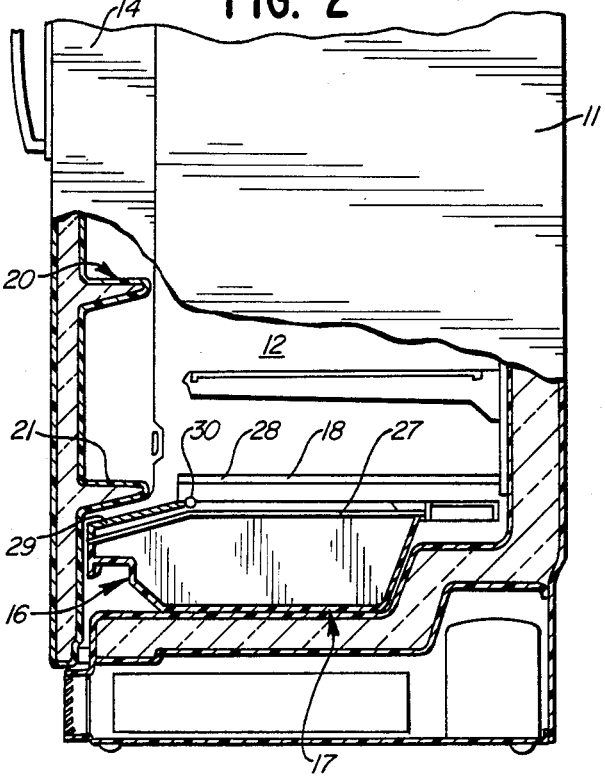
FIG. 3
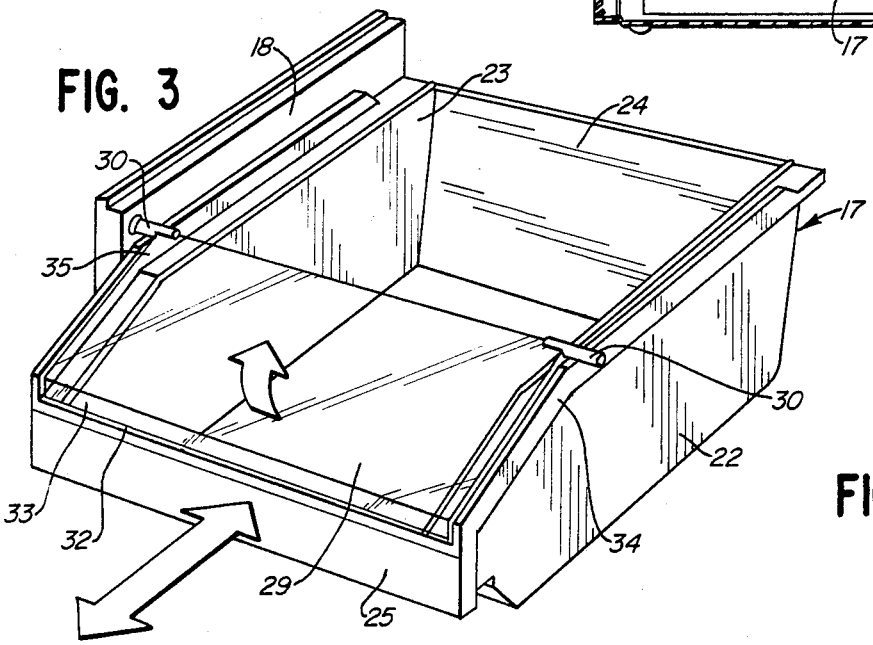
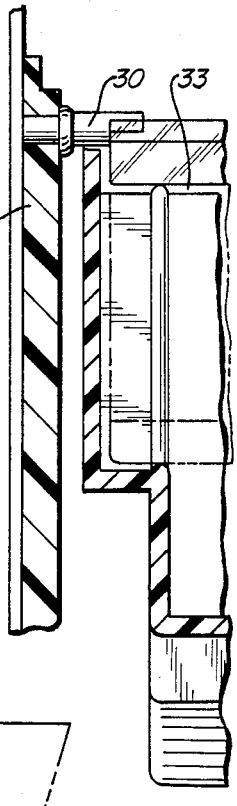
FIG. 5
FIG. 4
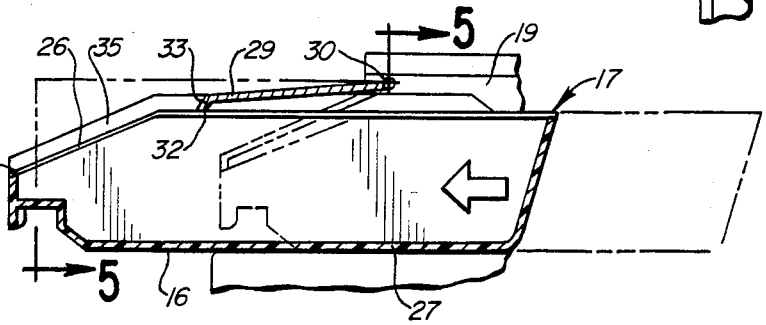

REFRIGERATOR CRISPER DRAWER STRUCTURE

BACKGROUND OF THE INVENTION

1. Field of the Invention

This invention relates to refrigeration apparatus, and in particular to crisper drawer structure for use in refrigerators and the like.

2. Description of the Background Art

It is conventional in refrigerators to provide one or more crisper drawers in the bottom of the refrigeration space within the cabinet. The drawers are conventionally movably carried on guides so as to permit their withdrawal from the refrigeration space when the front door of the refrigerator is opened, thereby providing to the user access to vegetables and the like stored in the crisper drawers. To maintain the crispness of the stored food, it is desirable to close the top of the drawer in the storage position within the refrigerated space.

In one form, the drawer is provided with a cover movable with the drawer which must be removed when the drawer is moved to the access position. It has also been conventional to utilize a superjacent shelf to define a fixed cover, the drawer being removed from under the fixed shelf cover when moved outwardly to the access position.

It has further been conventional to provide, in the door selectively closing the refrigerated space, a plurality of inwardly extending shelves for providing facilitated access to objects placed on the shelves when the door is swung to the open position. It has been conventional to include a lower shelf adjacent the crisper drawer. In one form, the crisper drawer is extended forwardly sufficiently to underlie the drawer shelf. In such structure, however, there has been a serious problem in that the user may place objects on the projecting portion of the cover when the door is in the open position, which objects tend to damage the shelf when the door is swung to the closed position without removing the objects from the projecting portion.

It has further been known to provide overlying shelves for crisper drawers wherein the front edge of the overlying fixed shelf is angled downwardly.

SUMMARY OF THE INVENTION

The present invention comprehends an improved refrigerator structure wherein the crisper drawer extends into underlying relationship to a shelf on the door. A cover member is movably mounted to overlie the front portion of the crisper drawer extending into underlying relationship with a shelf on the refrigerator door when the refrigerator door is in the closed position.

The cover member is positioned so as to define means for effectively preventing retention of articles thereon when covering the forward portion of the crisper drawer, with the crisper drawer in the storage position. By preventing such retention of articles thereon, damage to the overlying door shelf from striking such articles is effectively precluded.

The cover member is movable to a different position as a result of the crisper drawer being moved from the storage position to the access position. In the illustrated embodiment, the cover member is swung to a generally horizontal disposition when the crisper drawer is brought to the access position.

In the illustrated embodiment, the cover member is pivotally mounted in the refrigerator cabinet and, more specifically, in the illustrated embodiment, is pivotally mounted to the crisper drawer guides slidably supporting the crisper drawer in the refrigerator cabinet for selective disposition in the storage and access positions.

In the illustrated embodiment, the front portion of the crisper drawer is defined by an inclined top edge against which the movable cover member abuts in the storage disposition of the crisper drawer.

The cover member is automatically swung upwardly from the angled disposition as a result of the crisper drawer being moved forwardly to the access position and is automatically returned to the angled disposition overlying the front portion of the crisper drawer when it is returned to the storage disposition. Thus, any articles inadvertently placed on the generally horizontally extending cover member in the access position of the crisper drawer will tend to be removed therefrom automatically when the crisper drawer is returned to the storage position prior to the closing of the refrigerator door.

The angled arrangement of the cover member inhibits glare from light reflecting therefrom to enhance the viewing of articles in the drawer.

The refrigerator structure of the present invention is extremely simple and economical of construction while yet providing the improved features discussed above.

BRIEF DESCRIPTION OF THE DRAWING

Other features and advantages of the invention will be apparent from the following description taken in connection with the accompanying drawing wherein:

FIG. 1 is a perspective view of a refrigeration apparatus having a crisper drawer structure embodying the invention;

FIG. 2 is a fragmentary enlarged right side elevation, with a portion shown in vertical section to illustrate in greater detail the arrangement of the crisper drawer structure;

FIG. 3 is a perspective view of the crisper drawer structure;

FIG. 4 is a fragmentary vertical section illustrating the disposition of the cover member in the storage and access position of the crisper drawer; and FIG. 5 is a fragmentary enlarged transverse vertical section illustrating the pivotal mounting of the cover member.

PREFERRED EMBODIMENT OF THE INVENTION

In the illustrative embodiment of the invention as disclosed in the drawing, a refrigeration apparatus generally designated 10 is shown to comprise a refrigerator/freezer apparatus having a cabinet 11 defining an above-freezing temperature space 12 and a freezer space 13 selectively closed by front doors 14 and 15, respectively.

The present invention is concerned with the relationship between a front portion 16 of a crisper drawer 17 slidably mounted in the lower portion of the refrigerator space 12 between guide wall portions 18 and 19.

As best seen in FIG. 2, the refrigerator space door 14 is provided with a plurality of vertically spaced, inwardly projecting shelves 20, including a lowermost shelf 21. As shown, the shelf 21 may be disposed to be closely superjacent the front portion 16 of crisper drawer 17 when door 14 is in the closed disposition.

As best seen in FIG. 3, crisper drawer 17 comprises an upwardly opening drawer having sidewalls 22 and 23, a vertical rear wall 24, and a front wall 25. The upper edge 26 of the sidewalls 22 and 23, at the front portion 16 of the crisper drawer, is inclined forwardly downwardly, as illustrated in FIG. 4. The rear portion 27 of the crisper drawer is received under the lowermost refrigerator space shelf 28 when the crisper drawer is moved rearwardly to the storage disposition illustrated in FIG. 2.

The front portion 16 of the crisper drawer is closed by a cover member 29 pivotally mounted to the guide walls 18 and 19 by pivots 30.

Front wall 25 of the crisper drawer defines a top edge 31 which is selectively abutted by the lower edge 32 of a downturned front flange 33 of the cover member when the cover member is arranged to close the front portion 16 of the crisper drawer in the storage position, as illustrated in FIG. 3, and as shown in broken lines in FIG. 4.

Thus, in the stored disposition of crisper drawer 17, the top of the crisper drawer is closed by the overlying refrigerator shelf 28 and the cover member 29. In this disposition, the cover member is angled downwardly forwardly so as to preclude the placement of articles thereon when the door 14 is swung to the open position. The cover member automatically swings to the horizontal disposition illustrated in full lines in FIG. 4 when the crisper drawer is brought forwardly to the access position wherein access to articles in the crisper drawer may be had through the uncovered front portion 16, as illustrated in FIG. 4.

When the drawer is returned to the storage disposition, the cover member automatically returns to the drawer-closing position of FIG. 3, thereby causing any articles which may have inadvertently been placed on the cover member when the drawer was in the forward access position, to drop therefrom prior to the closing of door 14 and thereby effectively precluding damage to the shelf 21, which would otherwise engage articles placed on the cover member 29 when the shelf 21 is brought to the superjacent disposition illustrated in FIG. 2.

In the illustrated embodiment, cover member 29 is formed of a transparent synthetic resin suitable for use in refrigerators. Thus, visual inspection of the contents of the crisper drawer may be had with the drawer in the storage disposition through the transparent cover member. Further, the inclined arrangement of the cover member in the storage disposition effectively precludes glare from interfering with the viewing of the articles in the crisper drawer by eliminating reflected glare.

The improved crisper drawer structure of the present invention provides for improved utilization of the refrigerator space 12 and provides improved viewability of the contents of the crisper drawer by the user.

As shown in FIGS. 3 and 4, the sidewalls 22 and 23 of the crisper drawer define upwardly projecting edge portions 34 and 35, respectively, between which the cover member 29 is received to effectively sealingly close the front portion 16 of the crisper drawer in the storage disposition.

The crisper drawer structure of the present invention is extremely simple and economical, while yet providing for facilitated viewability of the crisper drawer and effectively avoiding damage to the front door of the refrigerator by inadvertent impact of the drawer shelf 21 against articles on the cover member for the drawer.

The foregoing disclosure of specific embodiments is illustrative of the broad inventive concepts comprehended by the invention.

We claim:

1. In a refrigerator having a cabinet defining a compartment having a front access opening, a door selectively movable to a closed position closing said opening, said door having a horizontal shelf extending rearwardly into a forward portion of said compartment for storing articles thereon, a drawer defining an upwardly opening cavity including a front portion, and means for movably mounting the drawer in said compartment for selective disposition in a rearward storage position wherein said front portion of the cavity is disposed in said forward portion of said compartment and underlies the door shelf when the door is in said closed position, the improvement comprising:

a cover member;

mounting means for movably mounting said cover member in said cabinet to overlie said upwardly open cavity front portion when said drawer is in said storage position and to be moved to a different position as a result of the drawer being moved from said storage position; and means for effectively rejecting retention of any one of a plurality of different articles on said cover member when covering said cavity front portion in said storage position and permit free movement of said shelf to overlie said cover member overlying said cavity front portion in said storage position upon movement of the door to said closed position.

2. The refrigerator structure of claim 1 wherein said mounting means comprises means for selectively disposing said front portion of the cavity forwardly of its disposition in the storage position of the drawer following movement of said door from said closed position.

3. The refrigerator structure of claim 1 wherein said mounting means comprises means for selectively disposing said front portion of the cavity forwardly of its disposition in the storage position of the drawer following movement of said door from said closed position and means are provided for moving said cover member as an incident of movement of said drawer to said access position.

4. The refrigerator structure of claim 1 wherein said mounting means comprises means for selectively disposing said front portion of the cavity forwardly of its disposition in the storage position of the drawer following movement of said door from said closed position and to cause said cover member to overlie said cavity front portion solely as an incident of return of said drawer to said storage position.

5. The refrigerator structure of claim 1 wherein said mounting means comprises means for selectively disposing said front portion of the cavity forwardly of its disposition in the storage position of the drawer following movement of said door from said closed position, said means for mounting said cover member being arranged to dispose said cover member in a substantially horizontal position within said compartment when the drawer is in said access position.

6. The refrigerator structure of claim 1 wherein said mounting means comprises means for selectively disposing said front portion of the cavity forwardly of its disposition in the storage position of the drawer following movement of said door from said closed position, said means for mounting said cover member being arranged to dispose said cover member in a substantially horizontal position within said compartment when the drawer is in said access position, and said means for effectively preventing retention of articles on said cover member comprises means responsive to return of said drawer to said storage position for effectively removing from said cover member articles which may have been placed thereon when said cover member was in said substantially horizontal position.

7. In a refrigerator having a cabinet defining a compartment having a front access opening, a door selectively movable to a closed position closing said opening, said door having a horizontal shelf extending rearwardly into a forward portion of said compartment for storing articles thereon, a drawer defining an upwardly opening cavity including a front portion, and means for movably mounting the drawer in said compartment for selective disposition in a rearward storage position wherein said front portion of the cavity is disposed in said forward portion of said compartment and underlies the door shelf when the door is in said closed position, the improvement comprising:

a cover member;

mounting means for movably mounting said cover member in said cabinet to overlie said upwardly open cavity front portion when said drawer is in said storage position and to be moved to a different position as a result of the drawer being moved from said storage position; and means for selectively mounting said cover member in said cabinet in a forwardly and downwardly inclined disposition to overlie said cavity front portion when said drawer is in said storage position and effectively reject retention of any one of a plurality of different articles on said cover member when overlying said cavity front portion in said storage position and permit free movement of said shelf to overlie said cover member overlying said cavity front portion in said storage position upon movement of the door to said closed position.

8. The refrigerator structure of claim 7 wherein said drawer includes a front portion defining said cavity front portion and having a forwardly and downwardly inclined top edge, said cover member being substantially flush with said top edge when overlying said cavity front portion.

9. The refrigerator structure of claim 7 wherein said drawer includes guide means, and said cover member includes slide means adapted to slide on said guide means for moving said cover member to and from said inclined disposition as in incident of movement of said drawer to and from said storage position.

10. The refrigerator structure of claim 7 wherein said means for mounting said cover member comprises means for pivotally mounting said cover member to the cabinet at the rear of said cavity front portion.

11. The refrigerator structure of claim 7 wherein said cabinet includes drawer guides for guiding the drawer in moving to and from said storage position and said means for mounting said cover member comprises means for pivotally mounting the cover member to said drawer guides.

12. In a refrigerator having a cabinet defining a compartment, said compartment having a rear wall and sidewalls, said sidewalls defining an opening for access to said compartment, and a door selectively movable to a closed position closing said opening, said door having a horizontal shelf for storing articles thereon, a storage drawer in said compartment comprising:

a pan defining an upwardly opening cavity, said pan extending from said door when closed to the rear wall of said compartment, said pan being horizontally movable between a storage position and an access position;

a cover member superjacent said pan and overlying said upwardly opening cavity when said pan is in said storage position, said pan and said cover member each having a substantially fixed rearward portion and a forward portion underlying said door shelf when said door is closed, said forward portion of the cover member being movably associated with said rearward portion; and cooperating structure associated with said pan and cover member forward portions comprising means for rejecting placement of any one of a plurality of different articles for storage on said forward portion of said cover comprising a portion of the pan engaging said cover member forward portion to move the cover as an incident of movement of the pan between said access and storage positions.

13. The refrigerator of claim 12 wherein said cooperating structure comprises a tapered forward portion of said pan and the forward portion of said cover member being angularly displaced at an acute angle from the horizontal plane when the pan is in the storage position.

14. The refrigerator of claim 13 wherein said forward portion of said pan is tapered toward said door and said forward portion of said cover member is pivotally mounted to said rearward portion of the cover member for pivoting about an axis allowing movement of said cover member forward portion to a horizontal position when said pan is moved to the access position.

15. The refrigerator of claim 14 wherein said cover member comprises a transparent element.

* * * * *